US006820552B2

(12) United States Patent
Verschueren et al.

(10) Patent No.: US 6,820,552 B2
(45) Date of Patent: Nov. 23, 2004

(54) CLEANING METHOD FOR RECYCLING A PRINTING SUBSTRATE BY LASER ABLATION

(75) Inventors: Eric Verschueren, Merksplas (BE); Marc Van Damme, Bonheiden (BE)

(73) Assignee: AGFA-Gevaert (BE)

( * ) Notice: Subject to any disclaimer, the term of this patent is extended or adjusted under 35 U.S.C. 154(b) by 103 days.

(21) Appl. No.: 10/068,519

(22) Filed: Feb. 6, 2002

(65) Prior Publication Data

US 2002/0148375 A1 Oct. 17, 2002

Related U.S. Application Data

(60) Provisional application No. 60/271,857, filed on Feb. 27, 2001.

(30) Foreign Application Priority Data

Feb. 14, 2001 (EP) ..... 01000015

(51) Int. Cl.[7] ..... B41C 1/10
(52) U.S. Cl. ..... 101/467; 101/478
(58) Field of Search ..... 101/455–460, 101/462, 463.1, 465–467, 478; 430/302

(56) References Cited

U.S. PATENT DOCUMENTS

| | | | | | |
|---|---|---|---|---|---|
| 4,718,340 | A | * | 1/1988 | Love, III | 101/116 |
| 5,704,291 | A | * | 1/1998 | Lewis | 101/457 |
| 5,927,207 | A | * | 7/1999 | Ghosh et al. | 101/455 |
| 6,408,755 | B1 | * | 6/2002 | Meisters et al. | 101/478 |
| 2002/0066383 | A1 | * | 6/2002 | Jentzsch | 101/463.1 |

FOREIGN PATENT DOCUMENTS

| | | | |
|---|---|---|---|
| DE | 198 17 756 A1 | | 11/1998 |
| EP | 770497 | * | 5/1997 |
| EP | 1 072 402 A2 | | 1/2001 |

* cited by examiner

*Primary Examiner*—Stephen R. Funk
(74) *Attorney, Agent, or Firm*—Leydig, Voit & Mayer, Ltd.

(57) ABSTRACT

A method is disclosed for removing ink-accepting areas from a printing master by laser ablation, characterized in that the printing master comprises a substrate which comprises a support and a base layer, wherein the base layer contains a crosslinked hydrophilic binder and a metal oxide. The base layer prevents deterioration of the quality of the substrate due to the laser ablation. In a preferred embodiment, the same substrate is used in a number of consecutive printing cycles of on-press coating, on-press exposure, printing and cleaning.

17 Claims, No Drawings

CLEANING METHOD FOR RECYCLING A PRINTING SUBSTRATE BY LASER ABLATION

CROSS-REFERENCE TO RELATED PATENT APPLICATIONS

This patent application claims priority to Patent Application No. 01000015.6 filed in Europe on Feb. 14, 2001, which is incorporated by reference. This application further claims the benefit of U.S. Provisional Application No. 60/271,857 filed Feb. 27, 2001, which is incorporated by reference.

FIELD OF THE INVENTION

The present invention relates to a method for removing ink-accepting areas of a printing master so that its substrate can be recycled and used again for applying a coating thereto.

BACKGROUND OF THE INVENTION

Printing presses use a so-called printing master such as a printing plate which is mounted on a cylinder of the printing press. The master carries an image consisting of ink-accepting areas on its surface and a print is obtained by applying ink to said image and then transferring the ink from the master onto a receiver material, which is typically paper. In conventional lithographic printing, ink as well as an aqueous fountain solution (also called dampening liquid) are supplied to the lithographic image which consists of oleophilic (or hydrophobic, i.e. ink-accepting, water-repelling) areas as well as hydrophilic (or oleophobic, i.e. water-accepting, ink-repelling) areas. In so-called driographic printing, the lithographic image consists of ink-accepting and ink-abhesive (ink-repelling) areas and during driographic printing, only ink is supplied to the master.

Printing masters are generally obtained by the so-called computer-to-film method wherein various pre-press steps such as typeface selection, scanning, color separation, screening, trapping, layout and imposition are accomplished digitally and each color selection is transferred to graphic arts film using an image-setter. After processing, the film can be used as a mask for the exposure of an imaging material called plate precursor and after plate processing, a printing plate is obtained which can be used as a master.

In recent years the so-called computer-to-plate (CTP) method has gained a lot of interest. This method, also called direct-to-plate method, bypasses the creation of film because the digital document is transferred directly to a plate precursor by means of a so-called plate-setter. A special type of CTP processes involves the exposure of a plate precursor while being mounted on a plate cylinder of a printing press by means of an image-setter that is integrated in the press. This method may be called 'computer-to-press' and printing presses with an integrated plate-setter are sometimes called digital presses. A review of digital presses is given in the Proceedings of the Imaging Science & Technology's 1997 International Conference on Digital Printing Technologies (Non-Impact Printing 13). Computer-to-press methods have been described in e.g. EP-A 640 478, EP-A 770 495, EP-A 770 496, WO 94/1280, EP-A 580 394 and EP-A 774 364.

Two types of such on-press imaging methods are known. According to a first type, a printing plate precursor is mounted on a printing press, image-wise exposed, optionally developed, and then used as a printing master and finally removed from the press and disposed of, thus requiring a new plate material for each image. An example of this technology is the Quickmaster DI 46-4 (trade mark of Heidelberger Druckmaschinen, Germany). A drawback of this method is the need to use a new plate for each press run, thus increasing the cost of the printing process.

In a second type of on-press imaging systems, the same lithographic substrate is used in a plurality of press runs (hereinafter called printing cycles). In each printing cycle, one or more heat-sensitive or photosensitive layer(s) are coated on the lithographic substrate to make a printing plate precursor and after image-wise exposure and optional development a printing master is obtained. After the press-run, the ink-accepting areas of the printing master are removed from the lithographic substrate in a cleaning step so that the substrate is recycled and can be used in a next cycle of coating, exposing and printing without the need to mount a new plate on the cylinder. Examples of such on-press coating and on-press imaging systems are described in e.g. U.S. Pat. No. 4,718,340; U.S. Pat. No. 5,188,033; U.S. Pat. No. 5,713,287; EP-A 786 337 and EP-A 802 457. The substrate can be reused during a number of printing cycles, which is dependent on the delicate balance between the effectiveness of the cleaning step and the preservation of the lithographic quality of the substrate: an aggressive cleaning step effectively removes all traces of the lithographic coating but may attack the lithographic surface of the substrate; a mild cleaning step, on the other hand, reduces the risk of affecting the lithographic quality of the substrate but incomplete removal of the lithographic coating typically results in the appearance of ghost images (the image of a previous print job is visible in the next). In practice, the same substrate cannot be used indefinitely and needs to be replaced after a number of print cycles.

U.S. Pat. No. 4,718,340 discloses a method wherein the lithographic coating is removed from the substrate by laser ablation. The very high temperature that is generated in the ablated lithographic coating, however, damages the lithographic surface of typical substrates such as grained and anodized aluminum.

BRIEF SUMMARY OF THE INVENTION

It is an object of the present invention to provide a method for effectively cleaning the substrate of a printing master without affecting the quality of the substrate, so that it can be reused in a next printing cycle without the appearance of ghost images. This object is realized by the method for removing ink-accepting areas from a printing master by laser ablation, wherein the printing master comprises a substrate which comprises a support and a base layer, wherein the base layer contains a crosslinked hydrophilic binder and a metal oxide. Although applicable to other printing techniques such as letterpress printing, the method is especially suited for cleaning a lithographic printing master.

In a preferred embodiment, the present invention discloses a method of lithographic printing with a reusable substrate by (a) providing a substrate comprising a support and a base layer which contains a crosslinked hydrophilic binder and a metal oxide;

(b) applying one or more layer(s) on the base layer, thereby obtaining an imaging material;

(c) making a printing master having ink-accepting areas by image-wise exposure of the imaging material to heat or light and optionally processing the imaging material;

(d) printing;

(e) removing the ink-accepting areas from the printing master by laser ablation; and (f) repeating steps (b) through (d).

This cleaning method is used for recycling the substrate in an on-press coating and on-press exposure method. The method allows effective removal of ink-accepting areas from the substrate of the printing master (no ghost images in the subsequent printing cycle) without affecting the lithographic quality of the substrate, thereby allowing to use the same substrate in a large number of printing cycles of coating, exposing, printing and cleaning, said number being preferably larger than 5, more preferably larger than 10 and most preferably larger than 30.

DETAILED DESCRIPTION OF THE INVENTION

The substrate used in the methods of the present invention comprises a support and a base layer provided thereon.

The support may be a sheet-like material such as a plate or it may be a cylindrical element such as a sleeve that can be slid around the plate cylinder of a printing press. Alternatively, the support can also be the plate cylinder itself. It can also be a web that is sufficiently flexible so that it can be wound on a spool. The support may consist of plastic, a metal such as aluminum, or a composite or a laminate thereof, e.g. a laminate of plastic and metal. Preferred examples of plastic are polyethylene terephthalate (PET) film, polyethylene naphthalate film, cellulose acetate film, polystyrene film, polycarbonate film, etc. The plastic support may be opaque or transparent.

A particularly preferred support is an electrochemically grained and anodized aluminum support. The base layer described below effectively protects the grained aluminum oxide surface during the laser ablation step. The anodized aluminum support may be treated to improve the hydrophilic properties of its surface. For example, the aluminum support may be silicated by treating its surface with a sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or may be carried out at a slightly elevated temperature of about 30 to 50° C. A further interesting treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulfonic acid, polyvinylbenzenesulfonic acid, sulfuric acid esters of polyvinyl alcohol, and acetals of polyvinyl alcohols formed by reaction with a sulfonated aliphatic aldehyde It is further evident that one or more of these post treatments may be carried out alone or in combination. More detailed descriptions of these treatments are given in GB-A-1 084 070, DE-A-4 423 140, DE-A-4 417 907, EP-A-659 909, EP-A-537 633, DE-A-4 001 466, EP-A-292 801, EP-A-291 760 and U.S. Pat. No. 4,458,005.

When the support is a plastic film, it is advantageous to provide an adhesion improving layer, also called subbing layer, between the support and the base layer. Particularly suitable adhesion improving layers for use in accordance with the present invention comprise a hydrophilic binder and colloidal silica as disclosed in EP-A-619 524, EP-A-620 502 and EP-A-619 525. Preferably, the amount of silica in the adhesion improving layer is between 200 mg/m$^2$ and 750 mg/m$^2$. Further, the ratio of silica to hydrophilic binder is preferably more than 1 and the surface area of the colloidal silica is preferably at least 300 m$^2$/gram, more preferably at least 500 m$^2$/gram. The subbing layer may further comprise other adhesion-promoting agents such as organic sulfonic acids, titanates, silanes and zirconium compounds, e.g. ammonium zirconyl carbonate, zirconium oxide, zirconium propionate, and other zirconium-based compounds described in "The Use of Zirconium in Surface Coatings", Application Information, Sheet 117 (Provisional), by P. J. Moles, Magnesium Elektron, Inc., Flemington, N.J., USA.

The base layer comprises a hydrophilic binder which is cross-linked with a crosslinking agent such as formaldehyde, glyoxal, polyisocyanate or a hydrolyzed tetra-alkylorthosilicate as disclosed in EP-A 601 240, GB 1 419 512, FR 2 300 354, U.S. Pat. No. 3,971,660 and U.S. Pat. No. 4,284,705. Other preferred crosslinking agents are carbonates such as zinc carbonate or zirconium compounds, e.g. ammonium zirconyl carbonate, zirconium oxide, zirconium propionate, and other zirconium-based compounds described in "The Use of Zirconium in Surface Coatings", Application Information, Sheet 117 (Provisional), by P. J. Moles, Magnesium Elektron, Inc., Flemington, N.J., USA. The amount of crosslinking agent, in particular tetraalkyl orthosilicate, is preferably at least 0.2 parts per part by weight of hydrophilic binder, more preferably between 0.5 and 5 parts by weight, most preferably between 1 parts and 3 parts by weight. The thickness of the hydrophilic base layer is preferably in the range of 0.1 to 20 $\mu$m, more preferably 1 to 10 $\mu$m.

The hydrophilic binder for use in the base layer is e.g. a hydrophilic (co)polymer such as homopolymers and copolymers of vinyl alcohol, acrylamide, methylol acrylamide, methylol methacrylamide, acrylate acid, methacrylate acid, hydroxyethyl acrylate, hydroxyethyl methacrylate or maleic anhydride/vinylmethylether copolymers. The hydrophilicity of the (co)polymer or (co)polymer mixture used is preferably the same as or higher than the hydrophilicity of polyvinyl acetate hydrolyzed to at least an extent of 60% by weight, preferably 80% by weight. Poly(vinyl alcohol) (PVOH) is highly preferred.

The base layer also contains a metal oxide, preferably particles of an oxide of Ti, Zr, Hf or mixtures thereof. $TiO_2$ is highly preferred, more particularly $TiO_2$ having a particle size between 0.1 and 1 $\mu$m. In addition, a hydroxide of the metal may be present. The amount of metal oxide in the base layer is preferably between 60 and 90%, more preferably between 70 and 85% relative to the total weight of the layer. Preferably, the base layer is capable of reflecting any unabsorbed imaging radiation back into the image-recording layer(s).

According to the methods of the present invention, a coating which is capable of forming ink-accepting areas upon image-wise exposure and optional processing is provided on the above described substrate. The coating may consist of one or more imaging layer(s). Preferably, only a single layer is provided on the substrate. The imaging material thus obtained may be light- or heat-sensitive, the latter being preferred because of daylight-stability. The image-recording layer of the material is preferably non-ablative. The term "non-ablative" shall be understood as meaning that the image-recording layer is not substantially removed during the exposure step. The imaging material is preferably processless, i.e. a lithographic image is obtained immediately after exposure without wet processing, or it can be processed by the supply of dampening liquid and/or ink, i.e. simply by starting the pressrun.

The material can be positive-working, i.e. the exposed areas of the coating define the non-printing areas of the master, or negative-working, i.e. the exposed areas of the coating define the printing areas of the master. Two embodiments of a highly preferred negative-working with a single image-recording layer will now be discussed.

In a first highly preferred embodiment, the working mechanism of the imaging layer relies on the heat-induced coalescence of hydrophobic thermoplastic polymer particles, preferably dispersed in a hydrophilic binder, as described in e.g. EP 770 494; EP 770 495; EP 770 497; EP 773 112; EP 774 364; and EP 849 090. The coalesced polymer particles define a hydrophobic, printing area that is not readily removable with dampening liquid and/or ink whereas the unexposed layer defines a non-printing area which is readily removable with dampening liquid and/or ink. The thermal coalescence can be induced by direct exposure to heat, e.g. by means of a thermal head, or by the light absorption of one or more compounds that are capable of converting light, more preferably infrared light, e.g. emitted by a solid state laser, into heat. Particularly useful light-to-heat converting compounds are for example dyes, pigments, carbon black, metal carbides, borides, nitrides, carbonitrides, bronze-structured oxides, and conductive polymer dispersions such as polypyrrole, polyaniline or polythiophene-based conductive polymer dispersions. Infrared dyes and carbon black are highly preferred.

The hydrophobic thermoplastic polymer particles preferably have a coagulation temperature above 35° C. and more preferably above 50° C. Coagulation may result from softening or melting of the thermoplastic polymer particles under the influence of heat. There is no specific upper limit to the coagulation temperature of the thermoplastic hydrophobic polymer particles, however the temperature should be sufficiently below the decomposition of the polymer particles. Preferably, the coagulation temperature is at least 10° C. below the temperature at which the decomposition of the polymer particles occurs. Specific examples of hydrophobic polymer particles are e.g. polyethylene, polyvinyl chloride, polymethyl (meth)acrylate, polyethyl (meth) acrylate, polyvinylidene chloride, polyacrylonitrile, polyvinyl carbazole, polystyrene or copolymers thereof. Most preferably used is polystyrene. The weight average molecular weight of the polymers may range from 5,000 to 1,000,000 g/mol. The hydrophobic particles may have a particle size from 0.01 $\mu$m to 50 $\mu$m, more preferably between 0.05 $\mu$m and 10 $\mu$m and most preferably between 0.05 $\mu$m and 2 $\mu$m. The amount of hydrophobic thermoplastic polymer particles contained in the image forming layer is preferably between 20% by weight and 65% by weight and more preferably between 25% by weight and 55% by weight and most preferably between 30% by weight and 45% by weight.

Suitable hydrophilic binders are for example synthetic homo- or copolymers such as a polyvinylalcohol, a poly (meth)acrylic acid, a poly(meth)acrylamide, a polyhydroxyethyl(meth)acrylate, a polyvinylmethylether or natural binders such as gelatin, a polysacharide such as e.g. dextran, pullulan, cellulose, arabic gum, alginic acid.

In the second highly preferred embodiment, the imaging layer comprises an aryldiazosulfonate homo- or copolymer which is hydrophilic and removable in dampening liquid and/or ink before exposure and rendered hydrophobic and less removable after such exposure. The exposure can be done by the same means as discussed above in connection with thermal coalescence of polymer particles. Alternatively, the aryldiazosulfonate polymer can also be switched by exposure to UV light, e.g. by a UV laser or a UV lamp.

Preferred examples of such aryldiazosulfonate polymers are the compounds which can be prepared by homo- or copolymerization of aryldiazosulfonate monomers with other aryldiazosulfonate monomers and/or with vinyl monomers such as (meth)acrylic acid or esters thereof, (meth) acrylamide, acrylonitrile, vinylacetate, vinylchloride, vinylidene chloride, styrene, $\alpha$-methyl styrene etc. Suitable aryldiazosulfonate polymers for use in the present invention have the following formula:

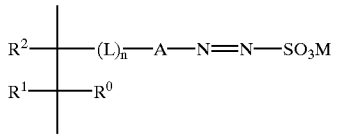

wherein $R^{0,1,2}$ each independently represent hydrogen, an alkyl group, a nitrile or a halogen, e.g. Cl, L represents a divalent linking group, n represents 0 or 1, A represents an aryl group and M represents a cation. L preferably represents divalent linking group selected from the group consisting of —$X_t$—$CONR^3$—, —$X_t$—COO—, —X— and —$X_t$—CO—, wherein t represents 0 or 1, $R^3$ represents hydrogen, an alkyl group or an aryl group, X represents an alkylene group, an arylene group, an alkylenoxy group, an arylenoxy group, an alkylenethio group, an arylenethio group, an alkylenamino group, an arylenamino group, oxygen, sulfur or an aminogroup. A preferably represents an unsubstituted aryl group, e.g. an unsubstituted phenyl group or an aryl group, e.g. phenyl, substituted with one or more alkyl group, aryl group, alkoxy group, aryloxy group or amino group. M preferably represents a cation such as $NH_4^+$ or a metal ion such as a cation of Al, Cu, Zn, an alkaline earth metal or alkali metal.

Suitable aryldiazosulfonate monomers for preparing the above polymers are disclosed in EP-A 339393, EP-A 507008 and EP-A 771645.

As mentioned above, the imaging material may also comprise one or more auxiliary layer(s) provided on the lithographic substrate, in addition to the image-recording layer(s). The light absorbing compound may be present in another layer close to the layer which contains the other ingredients mentioned above, such as the hydrophobic thermoplastic polymer particles and the aryldiazosulfonate polymer. Or the imaging material may comprise a protective top layer which is removable by the processing liquid, dampening liquid and/or ink and which provides protection against handling or mechanical damage. A suitable protective top layer comprises polyvinylalcohol.

The image-recording and auxiliary layer(s) can be applied on the substrate by heat- or friction-induced transfer from a donor material as described in EP 1 048 458, or by powder coating, e.g. as described in EP-A 974 455 and EP-A 99203682, filed on Nov. 3, 1999, or by coating a liquid solution according to any known coating method, e.g. spin-coating, dip coating, rod coating, blade coating, air knife coating, gravure coating, reverse roll coating, extrusion coating, slide coating and curtain coating. An overview of these coating techniques can be found in the book "Modem Coating and Drying Technology", Edward Cohen and Edgar B. Gutoff Editors, VCH publishers, Inc, New York, N.Y., 1992. It is also possible to apply the coating solution to the substrate by printing techniques, e.g. ink-jet printing, gravure printing, flexo printing, or offset printing. Jetting as described in EP-A 00202700, filed on Jul. 7, 2000, is highly preferred.

According to another highly preferred embodiment, a coating solution is sprayed on-press by means of a head comprising a spray nozzle. Preferred values of the spraying parameters have been defined in EP-A 99203064 and EP-A 99203065, both filed on Sep. 15, 1999. In a preferred configuration, the spray head translates along the lithographic base in the axial direction of the press cylinder while the cylinder is rotating in the angular direction. Said press cylinder is preferably the plate cylinder that holds the printing master during printing.

Coating by spraying or jetting are the preferred techniques for applying an image-recording layer which comprises thermoplastic polymer particles or an aryldiazosulfonate polymer, as described above.

The imaging material used in the present invention can be exposed to heat or to light. The exposure is preferably carried out on-press, i.e. while the material is mounted on a press cylinder, preferably the plate cylinder that holds the printing master during printing. Exposure can be done by e.g. a thermal head, digitally modulated lamps, LEDs or a laser head. Preferably, one or more lasers such as a He/Ne laser, an Ar laser[s] or a violet laser diode are used. Most preferably, the light used for the exposure is not visible light so that daylight-stable materials can be used, e.g. a UV lamp or UV (laser) light or a laser emitting near infrared light having a wavelength in the range from about 700 to about 1500 nm is used, e.g. a semiconductor laser diode, a Nd:YAG or a Nd:YLF laser. The required laser power depends on the sensitivity of the image-recording layer, the pixel dwell time of the laser beam, which is determined by the spot diameter (typical value of modem plate-setters at $1/e^2$ of maximum intensity: 10–25 $\mu$m), the scan speed and the resolution of the exposure apparatus (i.e. the number of addressable pixels per unit of linear distance, often expressed in dots per inch or dpi; typical value: 1000–4000 dpi). More technical details of on-press exposure apparatuses are described in e.g. U.S. Pat. No. 5,174,205 and U.S. Pat. No. 5,163,368.

Preferably, the imaging material does not require a separate processing step, i.e. printing can be started immediately after exposure. Alternatively, the imaging material can be processed by e.g. supplying ink and/or fountain. In that embodiment, the steps of processing and printing are part of the same operation: after exposure, the printing process is started by feeding ink and/or fountain to the material; after the first few revolutions of the print cylinder (typically less than 20, more preferably less than 10), the imaging layer is completely processed and subsequently, high-quality printed copies are obtained throughout the press run. Both preferred embodiments of imaging materials described above, i.e. based on thermal coalescence of thermoplastic polymer particles or on aryldiazosulfonate polymers, are particularly suited for such a 'hidden' on-press processing method. The non-exposed areas of the image-recording layer are dissolved in the ink and/or fountain during the first runs of the printing press. Preferably, the removed components are transferred to the print paper.

The on-press processing of the imaging material can be preceded by an optional step wherein the image-recording layer is first moistened or allowed to swell by the supply of water or an aqueous liquid.

According to the methods of the present invention, the ink-accepting areas of the printing master are removed by laser ablation. During the cleaning step, the laser light is absorbed by (one of) the layers which are present on the substrate, the absorbed light is converted into heat and the temperature in the layer(s) is thereby raised sufficiently high to cause ablation by e.g. chemical decomposition or evaporation of the layer(s). It may be necessary to use a vacuum device for removing any debris or fumes generated during the ablation step. Such devices have been described in e.g. U.S. Pat. No. 5,934,197, U.S. Pat. No. 5,574,493 and EP-A 988 969.

It is preferred to add dyes or pigments, which have a high absorption at the emission wavelength of the laser used in the ablation step, to the image-recording and/or auxiliary layer(s). Preferably, the laser is an infrared laser, e.g. a $CO_2$ laser, a Nd:YAG laser, or one or more high-power laser diode(s). In order to avoid excessive heating of the substrate, it is preferred to use a pulsed laser, e.g. operating at a pulse rate of between 1 and 10 Hz. According to a preferred embodiment, the same laser device is used for image-wise exposing the imaging material and for the cleaning of the printing master after the end of the print job. In that embodiment, it is preferred to use different power settings, filters, modulators or any other known means to adjust the light intensity of the laser from a low value during the exposure step to a high value during the ablation step.

The cleaning step is preferably carried out on-press, i.e. while the material is mounted on a press cylinder, preferably the plate cylinder which holds the printing master during printing.

After the laser ablation step, the cleaned substrate can be reused in a next cycle of coating, exposure and printing. As mentioned above, the number of consecutive cycles using the same substrate is limited. When ghost images appear, due to ineffective cleaning, or the lithographic quality of the substrate deteriorates, due to wear of the hydrophilic layer, the substrate can be replaced by fresh material. In the embodiment wherein the substrate is flexible, a fresh substrate can be provided by unwinding this material from a roll. Such a roll can be located in the printing press, even in the print cylinder, e.g. by using a supply cassette comprising a supply spool and an uptake spool within the plate cylinder as described in EP-A 640 478. Alternatively, automatic plate-loading can also be obtained from a supply cassette containing pre-cut sheets of fresh substrate. Of course, manual loading of a fresh substrate is also within the scope of the present invention.

The following examples further illustrate the invention but, of course, should not be construed as in any way limiting its scope.

EXAMPLE 1 COMPARATIVE EXAMPLE

A 0.30 mm thick aluminum foil was degreased by immersing the foil in an aqueous solution containing 5 g/l of sodium hydroxide at 50° C. and rinsed with demineralized water. The foil was then electrochemically grained using an alternating current in an aqueous solution containing 4 g/l of hydrochloric acid, 4 g/l of hydroboric acid and 5 g/l of aluminum ions at a temperature of 35° C. and a current density of 1200 $A/m^2$ to form a surface topography with an average center-line roughness Ra of 0.5 $\mu$m.

After rinsing with demineralized water, the aluminum foil was etched with an aqueous solution containing 300 g/l of sulfuric acid at 60° C. for 180 seconds and rinsed with demineralized water at 25° C. for 30 seconds. The foil was subsequently subjected to anodic oxidation in an aqueous solution containing 200 g/l of sulfuric acid at a temperature of 45° C., a voltage of about 10 V and a current density of 150 $A/m^2$ for about 300 seconds to form an anodic oxidation film of 3 $g/m^2$ of $Al_2O_3$, then washed with demineralized water, post-treated with a solution containing polyvinylphosphonic acid and subsequently with a solution containing aluminum trichloride, rinsed with demineralized water at 20° C. during 120 seconds and dried.

A 2.61 wt. % solution in water was prepared by mixing a polystyrene latex, a heat absorbing compound and a hydrophilic binder. This solution was coated on the above described substrate. After drying, the image-recording layer had a thickness of 0.83 μm and contained 75 wt. % of the polystyrene latex, 10 wt. % of the infrared dye IR-1 (formula below), and 15 wt. % of polyacrylic acid (Glascol E15 commercially available at N.V. Allied Colloids Belgium) as hydrophilic binder.

IR-1

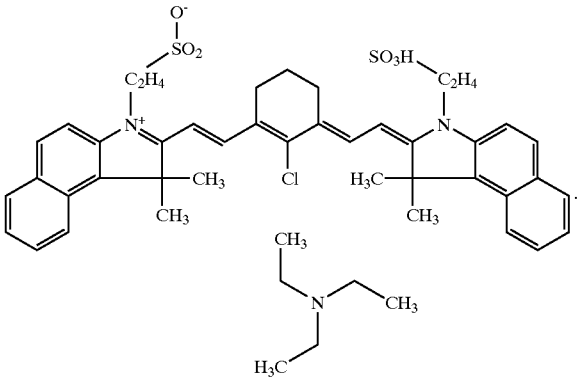

The above solution was sprayed onto the lithographic base, which was mounted on a cylinder rotating at a line speed of 164 m/min. The imaging element was coated by a spray nozzle moving in the axial direction of the cylinder at a speed of 1.5 m/min. The spray nozzle was mounted on a distance of 40 mm between the nozzle and the substrate. The flow rate of the spray solution was set to 7 ml/min. During the spray process an air pressure of 90 psi was used on the spray head. The coating was dried at an air temperature of 70° C. during the spraying process and additionally 30 seconds thereafter.

The spray nozzle used was of the type SUV76, an air assisted spray nozzle, commercially available at Spraying Systems Belgium, Brussels.

The above described imaging element was exposed in heat mode in a Creo 3244™ external drum platesetter at 2400 dpi at 150 rpm with a power setting of 15.5 Watt. The imaged plates were printed on a GTO46 printing press with K+E 800 Skinnex ink, fountain Rotamatic to a run length of 5000. The print quality was evaluated.

After printing, the plate was cleaned by laser ablation with a Nd:YAG laser emitting at 1064 nm and operating at a power setting of 4 W, a pulse frequency of 2 Hz, a line speed of 1 cm/s and a distance of 15 cm between plate and laser head. The ink was not removed before the cleaning step. Then, the same substrate was reused for a next coating, exposure and printing step as described above.

EXAMPLE 2

The same steps as mentioned in Example 1 were repeated but the grained and anodized aluminum was replaced by a lithographic substrate according to the invention.

218 g of an aqueous dispersion of 22 wt. % of hydrolyzed tetramethoxysilane was added to 446 g of an aqueous dispersion comprising 25% by weight of $TiO_2$ having an average particle size between 0.3 and 0.5 μm and 2.5% by weight of polyvinylalcohol (hydrolyzed polyvinylacetate, supplied by Wacker Chemie GmbH, F.R. Germany, under the trademark POLYVIOL WX). To this mixture, 10 g of a 4.1 wt. % solution of AKYPO OP80™ was added. Akypo OP80 is a surfactant, commercially available from Chemy. In addition, 2 g of a 5 wt. % solution of a fluorosurfactant, N-polyoxyethylene-ethyl-perfluoro-octane acid amide was added. The volume was then adjusted to 1000 ml with distilled water and finally, the pH was adjusted to 4.0 with NaOH.

The above coating solution was applied to a heat-set, biaxially oriented polyethylene terephthalate film with a thickness of 175 μm, so that a total dry thickness of 6.83 $g/m^2$ of the coating was obtained. The coating was applied at a wet thickness of 50 μm and the film was dried with air at 50° C. and a moisture content of 4 $g/m^3$.

EXAMPLE 3

In this example, the base layer of Example 2 was coated on the lithographic substrate of Example 1. In that way, a grained and anodized aluminum support was provided with a $TiO_2$/PVOH layer.

EXAMPLE 4

The same procedure as mentioned in Example 3 was used, but the coating of the base layer was applied at a total dry thickness of 2 $g/m^2$.

EXAMPLE 5

The same procedure as mentioned in Example 2 was used, however the preparation of the heat-mode imaging element was changed as follows:

152 g of an aqueous dispersion of 22 wt. % of hydrolyzed tetramethoxysilane was added to 312 g of an aqueous dispersion comprising 25% by weight of $TiO_2$ having an average particle size between 0.3 and 0.5 μm and 2.5% by weight of polyvinylalcohol (hydrolyzed polyvinylacetate, supplied by Wacker Chemie GmbH, F.R. Germany, under the trademark POLYVIOL WX). To this mixture, 10 g of a 4.1 wt. % solution of AKYPO OP80™ was added. Akypo OP80 is a surfactant, commercially available from Chemy. Then 330.6 g of an emulsion containing 12.05 wt. % of polystyrene was added. This emulsion was non-ionically stabilized. Also a solution of 2 g of infrared dye IR-2 (formula below) in 18 g of ethanol was added. Finally, the volume was adjusted to 1000 ml with distilled water and the pH was adjusted to 4.0 with NaOH.

This solution was applied to the lithographic substrate, described in Example 2, so that a total thickness of 0.5 $g/m^2$ was obtained. This layer was dried at an air temperature of 70° C. during the spraying process and additionally during 10 minutes. The spray nozzle used was of the type SUV76, an air assisted spray nozzle, commercially available at Spraying Systems Belgium, Brussels.

IR-2

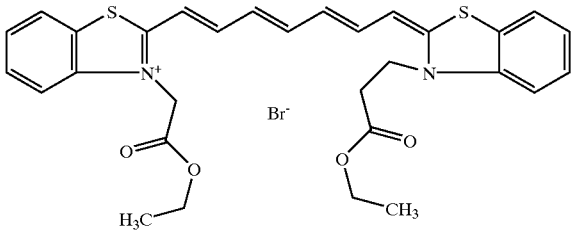

After the second cycle of coating, exposure and printing, as described above, the cleaning quality, coating quality and printing quality were evaluated by visual inspection. In this evaluation a quotation was given between 0 and 5, Wherein a value of 0 represents a very good quality and a value of 5 a very bad quality. Cleaning quality was assessed by inspecting the cleanliness of the substrate that was obtained after the first cycle. Coating quality was determined by inspecting the smoothness of the layer coated in the second cycle. And printing quality was determined by looking at the staining behavior and the presence of ghost images during the second cycle.

| Example | Clean Q | Coat Q | Print Q |
|---|---|---|---|
| 1 | 1 | 0 | 2 |
| 2 | 0 | 0 | 0 |
| 3 | 0 | 0 | 0 |
| 4 | 0 | 0 | 0 |
| 5 | 0 | 0 | 0 |

The above results indicate that a substantial improvement of the cleaning and printing quality can be obtained by providing the support with a crosslinked hydrophilic layer containing a metal oxide such as $TiO_2$.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of lithographic printing with a reusable substrate by (a) providing a substrate comprising a support and a base layer which contains a crosslinked hydrophilic binder and a metal oxide;

(b) applying one or more layer(s) on the base layer, thereby obtaining an imaging material containing a non-ablative image-recording layer;

(c) making a printing master having ink-accepting areas by image-wise exposure of the imaging material to heat or light without substantially removing the image-recording layer and optionally processing the imaging material;

(d) printing;

(e) removing the ink-accepting areas from the printing master by laser ablation; and (f) repeating steps (a) through (d).

2. The method according to claim 1 wherein the an image-recording layer comprises hydrophobic thermoplastic polymer particles or an aryldiazosulfonate polymer.

3. The method according to claim 2 wherein step (f) is repeated at least 5 times.

4. The method according to claim 2 wherein during step (e) ablation debris and/or fumes are removed by a vacuum device.

5. The method according to claim 2 wherein the laser is an infrared laser.

6. The method according to claim 2 wherein the laser is a pulsed laser.

7. The method according to claim 2 wherein the metal is Ti, Zr, Hf, or a mixture thereof.

8. The method according to claim 2 wherein the base layer further comprises a hydroxide of the metal.

9. The method according to claim 2 wherein the support is a plastic support, an aluminum support, or a laminate of a plastic and an aluminum support.

10. The method according to claim 1 wherein during step (e) ablation debris and/or fumes are removed by a vacuum device.

11. The method according to claim 1 wherein the laser is an infrared laser.

12. The method according to claim 1 wherein the laser is a pulsed laser.

13. The method according to claim 1 wherein the metal is Ti, Zr, Hf, or a mixture thereof.

14. The method according to claim 1 wherein the base layer further comprises a hydroxide of the metal.

15. The method according to claim 1 wherein the support is a plastic support, an aluminum support, or a laminate of a plastic and an aluminum support.

16. The method according to claim 15 wherein the aluminum support is a grained and anodized aluminum support.

17. The method according to claim 1 wherein step (f) is repeated at least 5 times.

* * * * *